US009539829B2

(12) United States Patent
Stephens et al.

(10) Patent No.: US 9,539,829 B2
(45) Date of Patent: Jan. 10, 2017

(54) PRINTING ON A MEDIA WEB

(71) Applicant: Hewlett-Packard Development Company, L.P., Houston, TX (US)

(72) Inventors: Bruce A. Stephens, Corvallis, OR (US); David C. Collins, Philomath, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/032,967

(22) PCT Filed: Oct. 31, 2013

(86) PCT No.: PCT/US2013/067835
§ 371 (c)(1),
(2) Date: Apr. 28, 2016

(87) PCT Pub. No.: WO2015/065446
PCT Pub. Date: May 7, 2015

(65) Prior Publication Data

US 2016/0279978 A1 Sep. 29, 2016

(51) Int. Cl.
*B41J 29/393* (2006.01)
*B41J 13/00* (2006.01)
*B41J 2/01* (2006.01)

(52) U.S. Cl.
CPC ..... *B41J 13/0009* (2013.01); *B41J 2/01* (2013.01)

(58) Field of Classification Search
CPC . B41J 2/17566; B41J 2/01; B41J 2002/15569; B41J 11/009; B41J 11/0015; B41J 11/42; B41J 19/205; B41J 19/207
See application file for complete search history.

(56) References Cited

U.S. PATENT DOCUMENTS 6,523,925 B1 2/2003 Driggers
7,665,817 B2 * 2/2010 Folkins ..... G03G 15/0152 347/14

(Continued)

FOREIGN PATENT DOCUMENTS

JP 2011063443 3/2011

OTHER PUBLICATIONS

International Search Report (ISA/KR), Jul. 28, 2014, PCT Patent Application No. PCT/US2013/067835, Hewlett-Packard Development Company, L.P.

(Continued)

*Primary Examiner* — Lamson Nguyen
(74) *Attorney, Agent, or Firm* — HP Inc Patent Department

(57) ABSTRACT

According to an example, printing on a media web may include outputting a first instruction to print a first frame on the media web. A first encoder count of an encoder may be determined between a first alignment mark and an end of frame for the first frame. Additionally, a second encoder count of the encoder may be determined between the first alignment mark for the first frame and a second alignment mark for a second frame. A difference value may then be calculated between the first encoder count and the second encoder count. Based on the difference value, a scaling factor of the encoder may be determined. Accordingly, another instruction may be output to print another frame on the media web based on the scaling factor.

15 Claims, 8 Drawing Sheets

(56) References Cited

U.S. PATENT DOCUMENTS

| | | | | |
|---|---|---|---|---|
| 7,762,642 | B2 * | 7/2010 | Fellingham | B41J 2/2132 347/16 |
| 8,019,255 | B2 | 9/2011 | Dobbertin et al. | |
| 8,033,624 | B2 | 10/2011 | Silva et al. | |
| 8,316,766 | B2 | 11/2012 | McLaughlin | |
| 2010/0329756 | A1 | 12/2010 | Mizes | |
| 2011/0200366 | A1 | 8/2011 | Boness et al. | |
| 2012/0020689 | A1 | 1/2012 | Inoue et al. | |
| 2013/0104760 | A1 | 5/2013 | Malik et al. | |

OTHER PUBLICATIONS

Kruciński, Martin. "Printer Media Path Closed Loop Control." In American Control Conference, 2009. ACC'09., pp. 3675-3680. IEEE, 2009.

* cited by examiner

PRINTING ON A MEDIA WEB

CROSS-REFERENCE TO RELATED APPLICATION

This application is a U.S. National Stage Application of and claims priority to International Patent Application No. PCT/US2013/067835, filed on Oct. 31, 2013, and entitled "PRINTING ON A MEDIA WEB", which is hereby incorporated by reference in its entirety.

BACKGROUND

A web press is a printing press into which a media web (e.g., paper) is automatically fed from a large roll. A web press enables printing of a high volume of materials using a continuous media web from which frames are cut after desired content is printed on the media web. Duplex printing is a web press feature that allows automatic printing on both sides of the media web. Web presses typically determine when and where to print using alignment marks on the media web.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
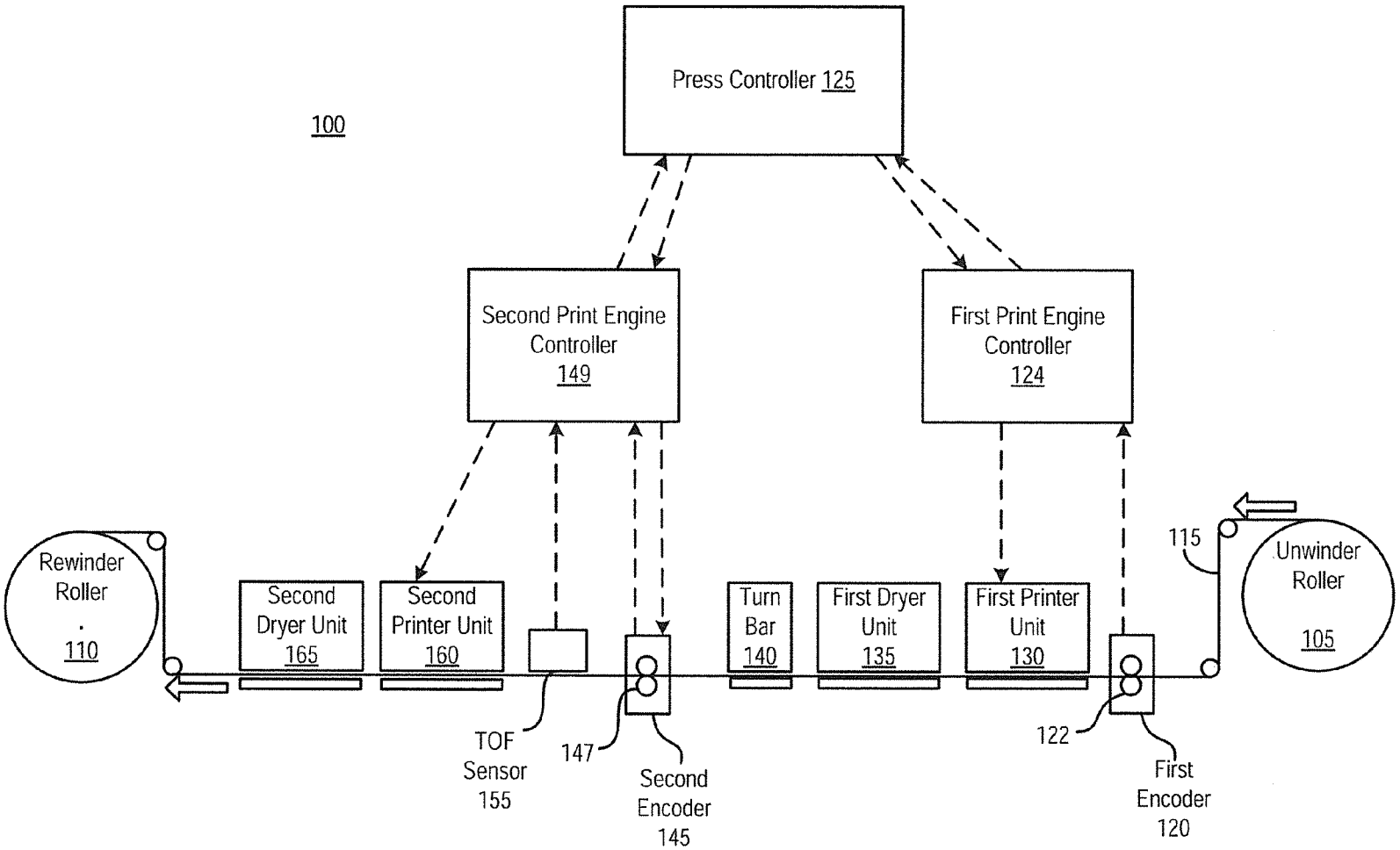
FIG. 1 illustrates an example web press, in which various aspects of methods and apparatuses disclosed herein may be implemented, according to an example of the present disclosure.

For simplicity and illustrative purposes, the present disclosure is described by referring mainly to examples. In the following description, numerous specific details are set forth in order to provide a thorough understanding of the present disclosure. It may be readily apparent however, that the present disclosure may be practiced without limitation to these specific details. In other instances, some methods and structures have not been described in detail so as not to unnecessarily obscure the present disclosure. As used herein, the term "includes" means includes but not limited to, the term "including" means including but not limited to. The term "based on" means based at least in part on. The terms "a" and "an" are intended to denote at least one of a particular element.

Examples of the present disclosure are directed to printing on a media web, and particularly to duplex printing on a media web, in which frames may be printed on a first (or equivalently, front) side and a second (or equivalently, back) side of a media web during a continuous printing operation. A continuous printing operation may include the printing of consecutive frames on the media web as the media web is fed through a web press. In the printing examples disclosed herein, a scaling factor may be determined and applied, for instance, during the printing of the frames on the back side of the media web, in which the scaling factor may be used to scale an encoder such that printing of successive frames on the back side of the media web may be controlled. In one regard, the scaling factor may be determined and applied to cause gapless frames printed on the back side of the media web to be substantially in alignment with the frames printed on the first side of the media web, thus preventing drifting errors. In addition, the scaling factor may be determined and applied to modify the sizes of gaps or overlaps between frames printed on the back side of the media web, i.e., such that the gaps between the frames have predetermined sizes. The modification to the sizes of the gaps or overlaps between the frames printed on the back side of the media web may be determined and applied to enable substantially gapless printing of successive back side frames. The modification may include, for instance, enlarging the back side frame and truncating a portion of the back side frame, i.e., clipping a number of rows of the back side frame, to minimize a gap formed between the end of a previously printed back side frame and the start of a next back side frame, while preventing the adjacent frames from overlapping each other.

According to an example of the methods and apparatuses disclosed herein, an apparatus, e.g., a print engine controller, may output a first instruction to print a first frame on a media web. The apparatus may also determine a first encoder count of an encoder between a first alignment mark and an end of frame for a first frame on the media web. Further, the apparatus may determine a second encoder count of the encoder between the first alignment mark for the first frame and a second alignment mark for a second frame on the media web. According to an example, an alignment mark detected signal may be received from a sensor in response to a detection by the sensor of an alignment mark (e.g., first alignment mark and second alignment mark) on the media web. The apparatus may calculate a difference value between the first encoder count and the second encoder count. A scaling factor of the encoder may be determined based on the difference value. The apparatus may then output an instruction to a second printer unit to initiate printing of another frame on a second side of the media web based on the determined scaling factor. In one regard, a scaling factor that causes the another frame to be substantially aligned with a subsequent frame may be selected. According to an example, the another frame may be construed as being substantially aligned with the subsequent frame if an offset between the end of the another frame and the start of the subsequent frame is less than 1 mm. In another example, the another frame may be construed as being substantially aligned with the subsequent frame if an offset between the end of the another frame and the start of the subsequent frame is less than 0.25 mm. In other examples, the another frame may be construed as being substantially aligned with the subsequent frame if no gap exists between the end of the another frame and the start of the subsequent frame.

A duplex printing system may use the detected arrival of an alignment mark (e.g., a top of frame (TOF) mark) printed on a first (or front) side of a media web to trigger the time and/or location that the web press should start printing on the second (or back) side of the media web. That is, after a back side printer finishes printing one frame, the back side printer may stop printing until the arrival of a next alignment mark on the media web is detected. Consequently, in conventional duplex printing systems, an unintended gap may be formed between adjacent frames printed on the media web because the conventional duplex printing systems wait for the detected arrival of the next alignment mark before printing the next frame. Accordingly, great care may need to be taken to ensure that printing of each back side frame is completed prior to the detected arrival of a subsequent alignment mark on the media web. For example, a printing system may expect a small gap between the end of one frame and the start of a next frame to allow one frame to finish printing an instant before a subsequent alignment mark arrives. As the gap size converges to zero, however, duplex printing becomes increasingly difficult without risking a TOF too soon error, which may be issued when printing of a frame is not finished prior to detection of an alignment mark that indicates that it is time to start printing the next frame. In addition, the gap size may converge to zero due to factors such as web stretch, web shrinkage, and imperfect encoder calibration, which may lead to front-to-back registration issues unless the frames are synchronized with each other.

More specifically, encoders in conventional printing systems may not measure the exact same encoder counts on the front side and the back side of a media web. One reason for this discrepancy may be that the media web may change size between printing of the front side and printing of the back side. For example, when the front side printer dispenses ink on the media web, the ink may relax the media web fibers and may cause the media web to grow. In addition, a front side dryer may dry the media web, which may cause the media web to shrink. The amount of shrinkage in the media web caused by the front side dryer may not be equivalent to the amount of growth in the media web caused by the ink. Accordingly, the net result may be, for example, that the media web may not have the same length following a printing operation that the media web had prior to the printing operation, and thus, the length of the media web during printing on the front side may differ from the length of the media web during printing on the back side.

Another reason that encoders in duplex printing systems may not measure the exact same encoder counts on the front side and the back side is that the encoder that is to monitor the back side may have an elevated temperature as compared with the encoder that is to monitor the front side. That is, the encoder that is to monitor the back side may become heated throughout a printing operation due to the dryer of the front side of the printing system. The increase in temperature may, for instance, cause the back side encoder's roller to grow in size and thus output erroneous readings.

According to an example of the present disclosure, frames printed on the back side of a media web may substantially be aligned with frames printed on the front side of the media web by compensating for differences in the measurements of encoder counts by the encoders of a duplex printing system. The substantial alignment may be maintained by incorporating the same printing triggering mechanism for back side printing as for front side printing. That is, a scaling factor of the back side encoder may be determined based upon the receipt of an alignment mark detected signal that may be generated by a sensor in response to a detection of an alignment mark on the media web, in which the scaling factor compensates for the differences in measurements made by the encoders. One result of the substantial alignment, and thus, the relatively high level of precision associated with providing the substantial alignment, is that consecutive frames may be printed on the back side with no or nearly no gaps between them, i.e., gapless printing may be performed.

According to an example, the scaling factor of the back side encoder may be determined through a calculation of a difference value between a first encoder count and a second encoder count. The first encoder count may be an encoder count between a first alignment mark and an end of frame for the first frame and the second encoder count may be an encoder count between the first alignment mark and a second alignment mark of a second frame. An increase in the difference value over multiple printing operations may be an indication that the alignment between frames on the front side and the back side is drifting. In addition, a relatively large difference value may be an indication that a front frame on the front side is relatively misaligned from a back frame on the back side that is directly opposite the front frame on the media web. In any regard, the scaling factor of the back side encoder may be determined from the difference value, i.e., to cause the printing of subsequent frames on the back side to align well with their respective frames on the first side. Moreover, the scaling factor may be adjusted as conditions with respect to either or both of the media web and back side encoder change, i.e., as the size of media web changes as additional ink is applied to the media web. In many instances, therefore, the determination of the scaling factor disclosed herein may also or alternatively pertain to the adjustment of a previously determined or adjusted scaling factor.

According to an example, the printing of the subsequent frames on the back side of the media web may be controlled or adjusted by varying the scaling factor for the back side encoder. That is, for instance, the subsequent frames may be printed at an adjusted size or ratio to cause the frames to be substantially in alignment with respective front frames in accordance with the scaling factor for the back side encoder.

According to another example, the printing of a current back side frame may be controlled or adjusted based upon a modification of a gap or an overlap between successive frames. A gap or overlap may be measured between the end of a previous back side frame and the arrival of an alignment mark for the current back side frame. That is, for instance, the modification may be intended to minimize or eliminate the gap between successive back side frames. In one regard, for instance, a back side frame may be enlarged in order to minimize the gap between the back side frame and a subsequent back side frame. A back side frame may be enlarged, for instance, by slightly increasing the distance between rows of printed material. Moreover, based on a determined scaling factor a back side frame may be printed in substantial alignment with a corresponding front side frame on the opposite side of the media web.

FIG. 1 illustrates a web press 100, in which various aspects of the methods and apparatuses disclosed herein may be implemented, according to an example. It should be understood that the web press 100 depicted in FIG. 1 may include additional elements and that some of the elements depicted therein may be removed and/or modified without departing from a scope of the web press 100.

In one implementation, the web press 100 may be implemented as a duplex printing web press, i.e., may print on both sides of a media web as the media web is fed through the web press 100. As shown in FIG. 1, the web press 100 may include an unwinder roller 105, a rewinder roller 110, a first encoder 120, a first print engine controller 124, a press controller 125, a first printer unit 130, a first dryer unit 135, a turn bar 140, a second encoder 145, a second print engine controller 149, a top-of-frame (TOF) sensor 155, a second printer unit 160, and a second dryer unit 165. As also shown, a media web 115 may be fed through the web press 100.

The web press 100 may include motors (not shown) for turning the unwinder roller 105 and the rewinder roller 110 to thus feed the media web 115 through the web press 100. Particularly, a motor for the unwinder roller 105 may rotate the unwinder roller 105 in a direction that causes the media web 115 to be fed toward the first encoder 120. The first encoder 120 may monitor the movement of the media web 115 as the media web 115 is fed past the first encoder 120. According to an example, the first encoder 120 may be coupled to the first encoder roller 122 and may track encoder counts (i.e., pulses) of the first encoder 120, for instance, by calculating the number of rotations that the first encoder roller 122 undergoes and/or the position of the first encoder roller 122, to track the distance that the media web 115 travels. The first encoder 120 may send a first encoder signal to the first print engine controller 124, in which the first encoder signal may include information regarding the tracked encoder count of the first encoder 120.

The press controller 125, according to an example, may cause a selected throughput rate or displacement rate of the media web 115 between the rewinder roller 110 and the unwinder roller 105. In addition, the press controller 125 may coordinate the operations of the first print engine controller 124 and the second print engine controller 149. The first print engine controller 124 may receive the first encoder signal originating from the first encoder 120 and may trigger the printing on a first side (e.g., front side) of the media web 115 by the first printer unit 130 based on the encoder count information received from the first encoder signal 120. The first print control engine controller 124 may control the resolution, print speed, and/or toner used by the first printer unit 130. For example, the first print engine controller 124 may trigger the first printer unit 130 to print a frame, i.e., an image, text, color, etc., at a particular location on the first side of the media web 115, to print a next frame following completion of the printing of the frame, etc. Alternatively, the print engine controller 124 may wait until the arrival of an alignment mark prior to triggering the printing of a subsequent frame on the media web 115.

The first printer unit 130 may include a number of printheads (not shown) that are to dispense droplets of ink onto the media web 115 in a precise manner to form the frame with desired features, i.e., colors, shapes, text, etc. The printheads may be any of thermal inkjet, piezoelectric inkjet, etc., types of printheads.

According to an example, the first printer unit 130 may print an alignment mark (e.g., a top-of-frame (TOF) mark) at any location on the first side of the media web 115, for instance, immediately prior to printing a frame. The alignment mark may be any suitable character, design, shape, etc., that the TOF sensor 155 may detect. According to another example, the alignment mark may be pre-imposed on the first side of the media web 115 and may be, for instance, a printed mark, a hole, etc. In any regard, after the frame has been printed on the first side of the media web 115 by the first printer unit 130, the media web 115 may be fed to the first dryer unit 135, which may apply heat to the media web 115 to dry the ink on the media web 115.

Following the first dryer unit 135, the media web 115 may be fed through the turn bar 140, which may flip the media web 115 over for duplex printing on a second side (e.g., the back side) of the media web 115. The media web 115 may then be fed through the second encoder 145, which may include substantially the same features and attributes as the first encoder 120 described above. According to an example, the second encoder 145 may be coupled to a second encoder roller 147 and may track encoder counts of the second encoder 145 to determine the distance that the media web 115 has traveled. The second encoder 145 may send a second encoder signal to the second print engine controller 149, in which the second encoder signal may include information regarding the tracked encoder counts of the second encoder 145. The second print engine controller 149 may include substantially the same features and attributes as the first print engine controller 124 described above.

The media web 115 may be fed past the TOF sensor 155, which may monitor the media web 115 as the media web 115 is fed past the TOF sensor 155 to detect an alignment mark on the media web 115. In response to a detection of an alignment mark, the TOF sensor 155 may send an alignment mark detected signal to the second print engine controller 149. Thus, for instance, the TOF sensor 155 may detect an alignment mark printed by the first printer unit 130 immediately prior to the printing of a frame on the first side of the media web 115. The TOF sensor 155 may be positioned to detect the alignment mark directly on the side of the media web 115 on which the alignment mark is printed or to detect the alignment mark through the media web 115.

The second print engine controller 149 may receive information regarding the tracked encoder counts from the second encoder 145 and information regarding the detection of an alignment mark from the TOF sensor 155. The second print engine controller 149 may determine a scaling factor of the second encoder 145 based upon the information received from either or both of the second encoder 145 and the TOF sensor 155. More particularly, the second print engine controller 149 may determine a scaling factor for the second encoder 145 that compensates for the differences in a first encoder count of the second encoder 145 and a second encoder count of the second encoder 145. The first encoder count may, for instance, be used to determine the distance between a first alignment mark and an end of frame for the first frame. The second encoder count may, for instance, be used to determine the distance between the first alignment mark for the first frame and a second alignment mark for a second frame. That is, the signals received from the TOF sensor 155 and the second encoder 145 may indicate that the encoder count for an end of a printed frame differs from an encoder count for an arrival of an alignment mark for another frame.

According to an example, the second print engine controller 149 may determine the scaling factor of the second encoder 145 through a calculation of a difference value between the first encoder count and the second encoder count. That is, the second print engine controller 149 may determine the scaling factor to be a larger value if the difference value is larger, determine the scaling factor to be a smaller value if the difference value is smaller, etc. An increase in the difference value over multiple printing operations may be an indication that the alignment between frames on the front side and the back side is drifting. In addition, a relatively large difference value may be an indication that a back frame on the back side is relatively misaligned from a front frame on the front side that is directly in front of the back frame. In any regard, the press controller 125 may determine the scaling factor of the second encoder 145 from the difference value.

The second print engine controller 149 may determine whether the determined difference value exceeds a predetermined acceptable threshold. If the difference value does not exceed the predetermined acceptable threshold, the second print engine controller 149 may issue a print command to the second printer unit 160 with a previously set scaling factor, which may include no scaling factor. The second printer unit 160 may include substantially the same features and attributes as the first printer unit 130 described above. If, however, the difference value exceeds the predetermined acceptable threshold, the second print engine controller 149 may determine a scaling factor of the second encoder 145 based on the difference value. In this example, the second print engine controller 149 may issue a print command with the determined scaling factor to the second printer unit 160 to print a back frame on the second side of the media web 115. The second print engine controller 149 may implement the determined scaling factor in the printing of the back frame on the second side of the media web 115 to cause the back frame to be in substantial alignment with the front frame.

According to another example, and as discussed above, the second print engine controller 149 may adjust the scaling factor of the second encoder 145 so that the second printer unit 160 may print a frame on the second side at an adjusted size on the media web 115. The adjusted scaling of the second encoder 145, therefore, may modify a size of a gap or overlap between frames on the second side of the media web 115. The gap or overlap may be a measurement between the end of a previous frame and the arrival of an alignment mark for the frame. The size of the gap or overlap may be modified, for instance, to compensate for a calculated difference between the first encoder count and the second encoder count based upon data received from the second encoder 145 and the TOF sensor 155. In this example, the second print engine controller 149 may issue a print command to the second printer unit 160 to print a frame on the second side of the media web 115 with an adjusted scaling factor to modify the size of the gap or overlap. In addition, the second print engine controller 149 may cause the second printer unit 160 to modify the size of the frame to minimize the size of the gap or overlap between the frame and a subsequently printed frame on the back side of the media web. That is, for instance, the second print engine controller 149 may cause the second printer unit 160 to enlarge the printed frame. In addition or alternatively, the second print engine controller 149 may cause the second printer unit 160 to truncate a portion of the frame to prevent the frame from extending into a subsequent frame while minimizing the size of the gap between the successive frames on the back side of the media web 115.

After the second printer unit 160 has printed the second frame on the second side of the media web 115, the media web 115 may be fed to the second dryer unit 165, which may apply heat to the media web 115 to dry the ink on the media web 115. The printed media web 115 may then be fed to the rewinder roller 110 to rewind the printed media web 115 into a roll, according to an example.

Figure 2:
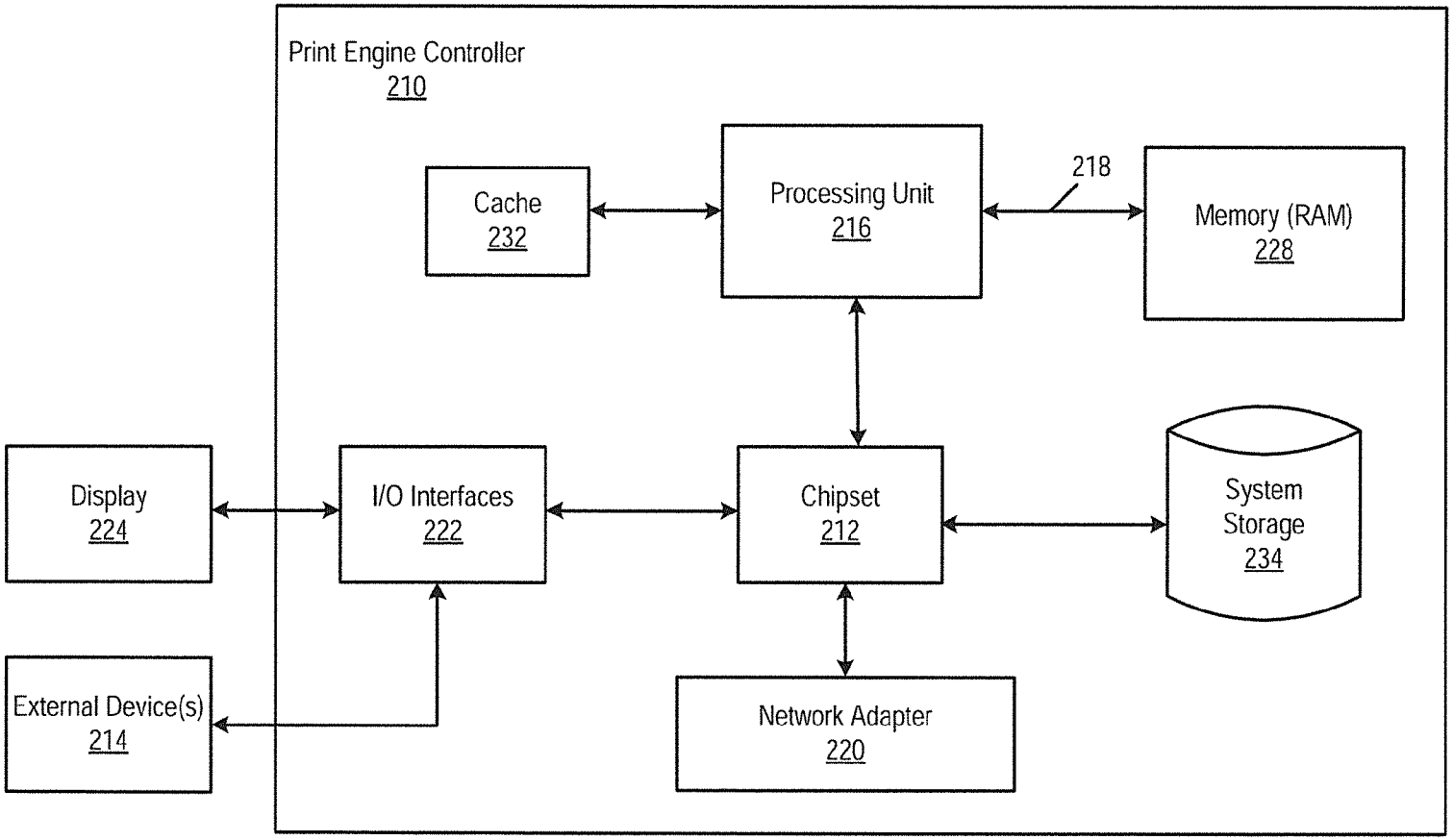
FIG. 2 illustrates a block diagram of an example print engine controller according to an example of the present disclosure.

FIG. 2 illustrates a block diagram of a print engine controller 210 for duplex printing using a scaling factor according to the examples disclosed herein. The print engine controller 210 is one example of a print engine controller and is not intended to suggest any limitation as to the scope of use or functionality of examples described herein. Regardless, the print engine controller 210 may be implemented and/or may perform any of the functionalities set forth herein.

In one implementation, the print engine controller 210 may be operational with numerous other general purpose or special purpose computing system environments or configurations. Examples of computing systems, environments, and/or configurations that may be used with the print engine controller 210 include, but are not limited to, personal computer systems, server computer systems, thin clients, thick clients, cellular telephones, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like. Special-purpose computer systems include hardware accelerators such as FPGAs (Field-Programmable Gate Arrays), GPUs (Graphics Processing Units), and similar systems, which may be used in lieu of or in addition to general-purpose processors.

The print engine controller 210 may comprise computer system-executable instructions, such as program modules, being executed by the print engine controller 210. In one implementation, program modules may include routines, programs, objects, components, logic, data structures, and so on that perform particular tasks or implement particular abstract data types. The print engine controller 210 may be practiced in distributed cloud computing environments where tasks are performed by remote processing devices that are linked through a communications network. In a distributed computing environment, program modules may be located in both local and remote computer system storage media including memory storage devices.

As shown in FIG. 2, the print engine controller 210 may be in the form of a general-purpose computing device, also referred to as a processing device. The components of the print engine controller 210 may include, but are not limited to, one or more processors (or processing units) 216, a system memory (RAM) 228, and a bus 218 that couples various system components including system memory 228 to processor 216. The print engine controller 210 may also include a chipset 212 to manage the data flow between the processor 216, memory 228, and external devices 214.

The bus 218 may represent any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

The print engine controller 210 may include a variety of non-transitory computer system readable media. Such media may be any available media that is accessible by the print engine controller 210, and may include both volatile and non-volatile media, removable and non-removable media.

The system memory 228 may include computer system readable media in the form of volatile memory, such as random access memory (RAM). The print engine controller 210 may also include cache memory 232. The print engine controller 210 may further include other removable/non-removable, volatile/non-volatile computer system storage media. By way of example only, a system storage 234 may be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each of the print engine controller 210 components may be connected to the bus 218 by one or more data media interfaces. As will be further depicted and described below, the memory 228 may include at least one program product having a set of program modules that are to carry out the functions of examples of the present disclosure.

The print engine controller 210 may also communicate with at least one external device 214, such as a keyboard, a pointing device, a display 224, etc.; a device that enables a user to interact with the print engine controller 210; and/or any devices (e.g., network card, modem, etc.) that enable the print engine controller 210 to communicate with one or more other computing devices. Such communication may occur via Input/Output (I/O) interfaces 222. Still yet, the print engine controller 210 may communicate with one or more networks, such as a local area network (LAN), a general wide area network (WAN), and/or a public network (e.g., the Internet) via a network adapter 220. As depicted, the network adapter 220 may communicate with the other components of the print engine controller 210 via the bus 218. It should be understood that although not shown, other hardware and/or software components may be used in conjunction with the print engine controller 210. Examples include, but are not limited to: microcode, device drivers, redundant processing units, external disk drive arrays, RAID systems, tape drives, and data archival storage systems, etc.

Figure 3:
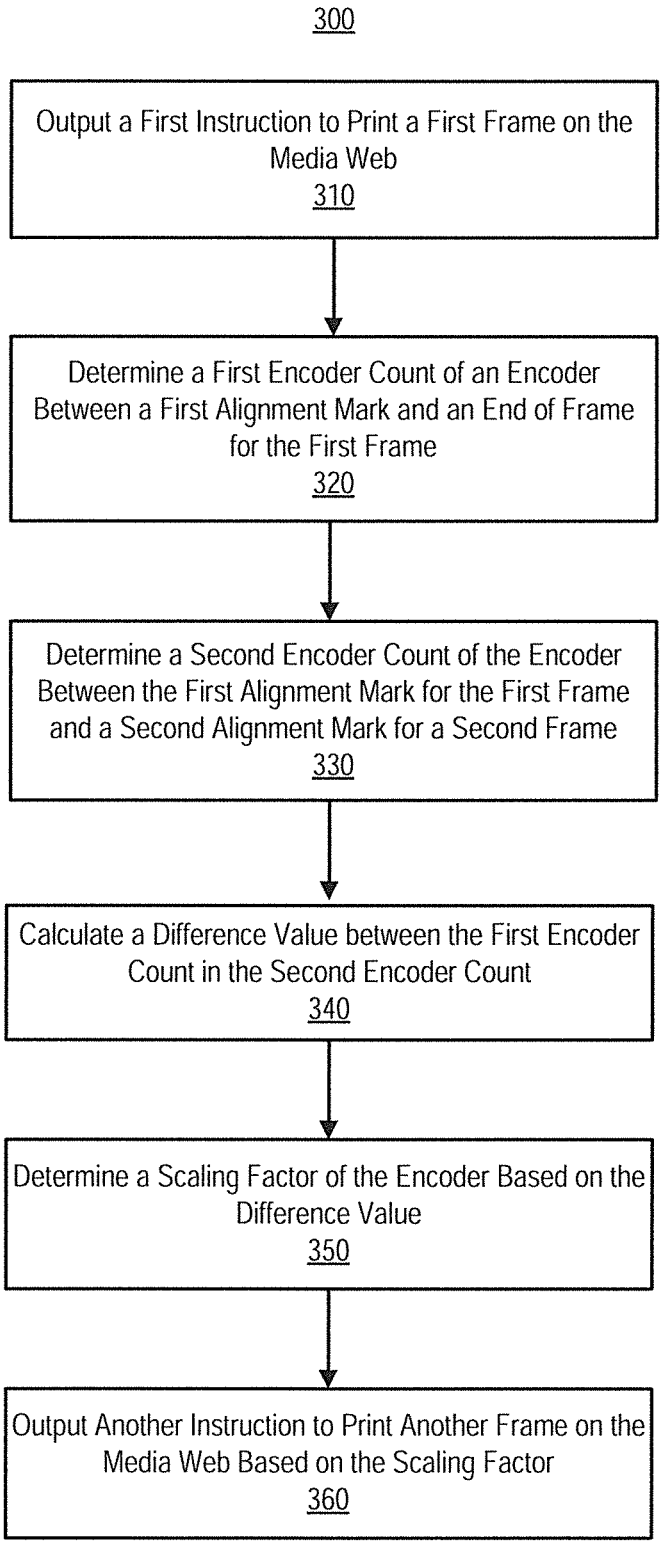
FIG. 3 illustrates a flow diagram of an example method for printing on a media web according to an example of the present disclosure.

With reference to FIG. 3, a flow diagram of a method 300 for printing on a media web is shown according to an example implementation. The method 300 may, for example, be implemented by the processing unit (processor) 216 of the print engine controller 210 as disclosed above in reference to FIG. 2. The method 300, according to an example, may include the determination of a scaling factor of an encoder that, when applied to the printing of a second frame on a second side of a media web, causes the second frame to be substantially in alignment with a first frame printed on a first side of the media web, thus preventing drifting errors.

According to an example, the second print engine controller 149 may output a first instruction to print a first frame the media web 115, as shown in block 310. For instance, the first frame may include a first alignment mark. As discussed above, the first printer unit 130 may have printed the alignment mark (such as a particular character, a color, shape, etc.), for instance, at a top of the first frame. In other examples, the alignment mark may be printed at any location on the first frame and may be another detectable mark on the media web 115, such as a hole, a series of lines, etc.

At block 320, a first encoder count of the encoder 145 between the first alignment mark and an end of frame for the first frame may be determined by the processing unit 216. As discussed above, the TOF 155 sensor may detect the first alignment mark and send a first alignment mark detected signal to the processing unit 216. The processing unit 216, which may issue the print commands to the second printer unit 160 as discussed above in reference to FIG. 1, may therefore, also monitor or otherwise be aware of when the first frame has finished printing according the disclosed examples herein. In any event, the processing unit 216 may receive an encoder signal from the second encoder 145, and based on the encoder signal and the first alignment mark detected signal received from the TOF sensor 155, may determine the first encoder count for the distance between the first alignment mark and the end of the first frame.

At block 330, a second encoder count of the encoder 145 between the first alignment mark for the first frame and a second alignment mark for the second frame of the media web 115 may be determined by the processing unit 216. The TOF sensor 155 may detect the first alignment mark and the second alignment mark, and thus, may send a first alignment mark detected signal and a second alignment mark detected signal to the processing unit 216, according to an example. Additionally, the processing unit 216 may receive an encoder signal from the second encoder 145, and based on the encoder signal, the first alignment mark detected signal, and second alignment mark detected signal received from the TOF sensor 155, may determine the second encoder count for the distance between the first alignment mark and the second alignment mark.

At block 340, a difference value between the first encoder count and the second encoder count may be calculated by the processing unit 216. As discussed above in reference to FIG. 1, for any number of reasons, the first encoder count may not match the second encoder count (e.g. media web shrinkage or growth).

At block 350, a scaling factor for the second encoder 145 may be determined by the processing unit 216 based on the calculated difference value. For example, the scaling factor for the second encoder 145 may be adjusted by a determined value to compensate for the calculated difference value. By way of example, the scaling factor may be determined using the following equation: new_scaling_factor=current_scaling_factor*(frame_size error*alpha)/frame_size, wherein the alpha value may be a scaling factor between 0 and 1. If alpha=1, the scaling factor may occur in one frame. If alpha=0.01, the scaling factor may occur within 100 frames. According to another example, the value of alpha may be 0.25 to allow method 300 to slowly approach an ideal set point. The error value may be the front to back alignment error for method 500 (FIG. 5) or the gap or overlap size for method 700 (FIG. 7) as further discussed below. However, the disclosed examples may employ many different closed loop control strategies to optimize the rate at which the system approaches an ideal encoder scaling value, the responsiveness of the system to changes, and the overshoot of the system (i.e., correcting more than necessary, and then adjusting the correction the other way). According to another example, a feedback method, such as a PID (proportional, integral, derivative) algorithm, may have tunable parameters that decide how much the scaling factor should be adjusted. The PID algorithm may attempt to move the absolute error back to zero, taking into account the accumulated error and the ongoing error. The PID algorithm may also have a dampening term that attempts to smooth out the adjustments to avoid oscillations due to over-corrections. Various manners in which the scaling factor may be determined are discussed in greater detail herein.

At block 360, the processing unit 216 may output another instruction to print another frame on the media web 115 based on the determined scaling factor for the second encoder 145. The determined scaling factor, for instance, may cause the another frame to be printed at an adjusted size or ratio, as instructed by an output from the processing unit 216 of the second print engine controller 149.

Figure 4:
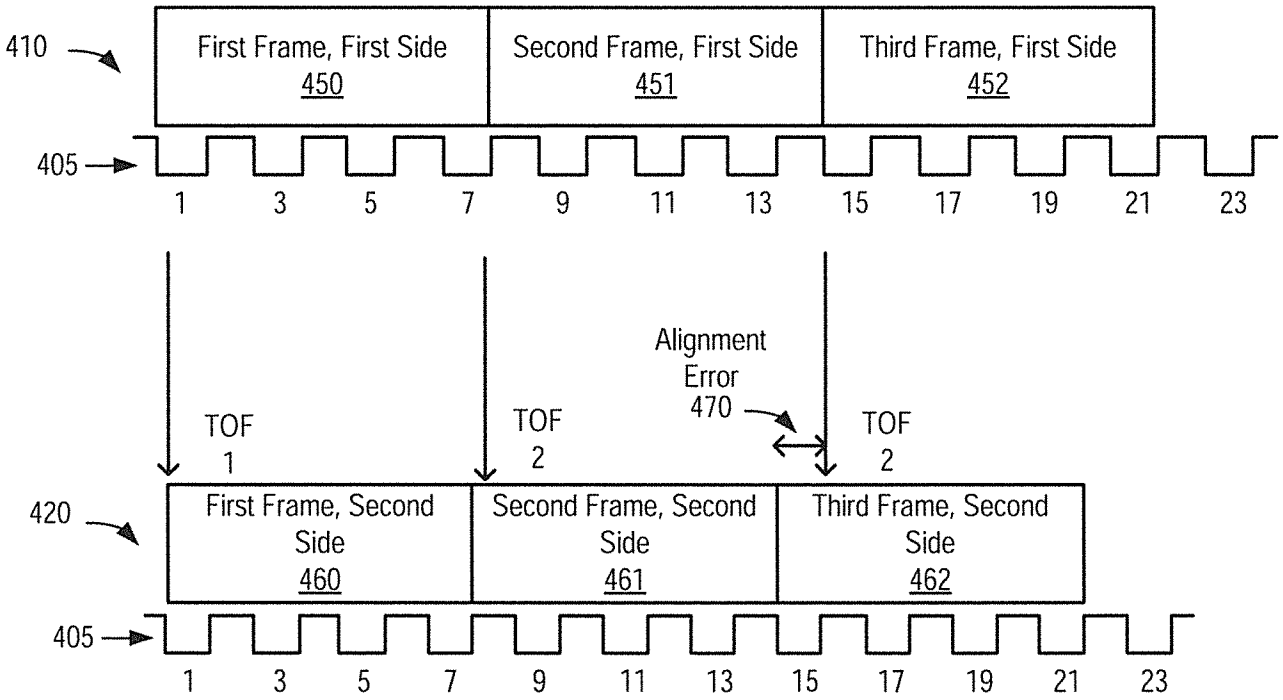
FIG. 4 illustrates an example timing diagram of gapless frame printing in duplex printing systems according to an example of the present disclosure.

FIG. 4 illustrates an example timing diagram of gapless frame printing in duplex printing systems, according to an example implementation. FIG. 4 is simplified for illustrative purposes. For example, the illustrated encoder counts (i.e., pulses) 405 are simplified to seven counts per frame for explanatory purposes. The examples disclosed herein are not limited to seven counts per frame and may designate any number of counts per frame as appropriate.

In the example of FIG. 4, a second side 420 of the media web 115 may have shrunk, which leads to first side frames 450, 451, 452 on the first side 410 of the media web 115 being misaligned with the second side frames 460, 461, 462 on the second side 420 of the media web 115. Particularly, due to the shrinkage of the media web 115, the end of the first frame of the second side 460 is printed short of TOF 2. Additionally, the end of the second frame of the second side 461 is printed even further short of TOF 3. This, for instance, causes an alignment error 470 between the second frame of the first side 451 and the second frame of the second side 461.

Figure 5:
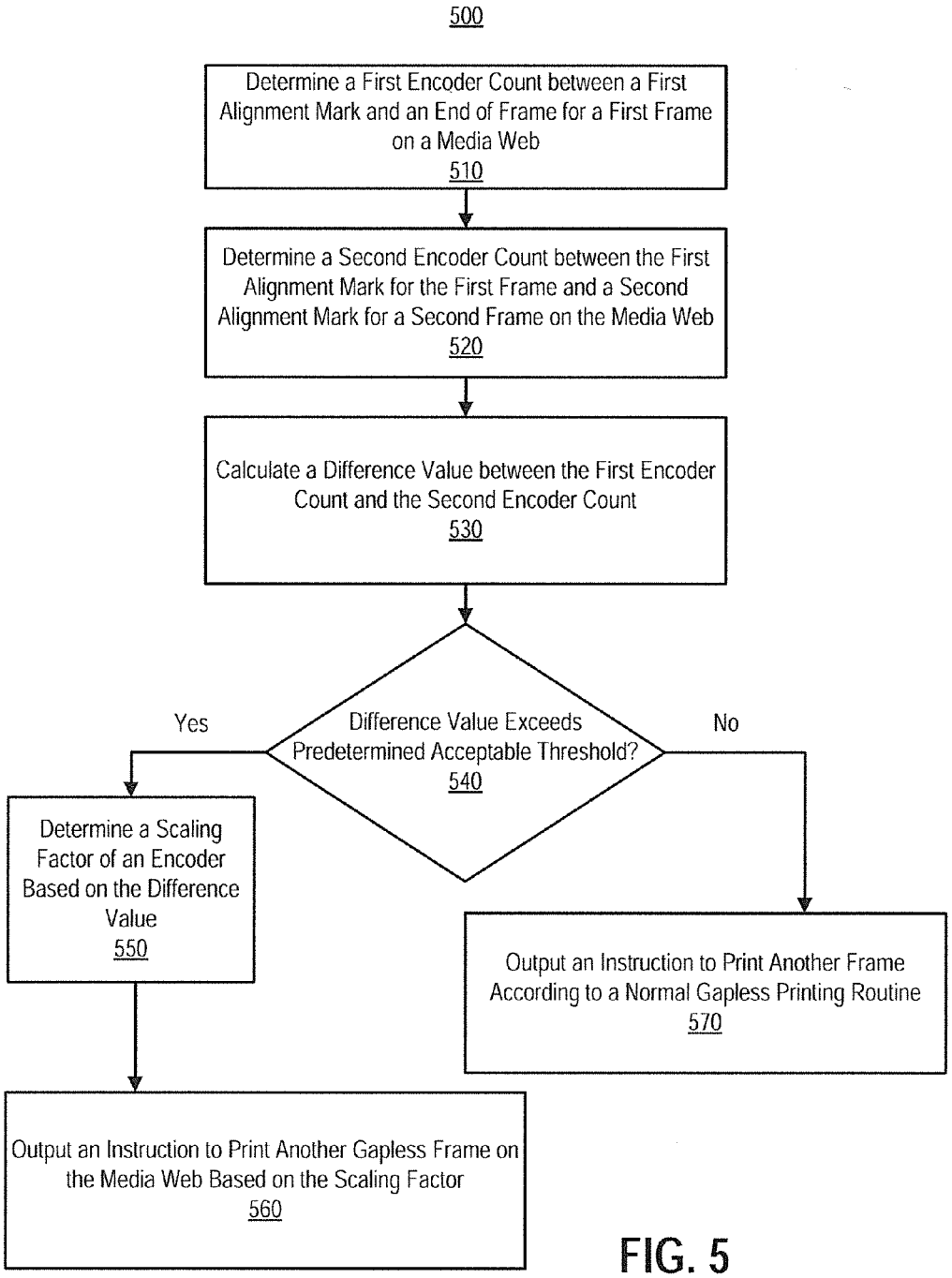
FIG. 5 illustrates a flow diagram of an example method for printing on a media web according to another example of the present disclosure.

FIG. 5 illustrates a flow diagram of a method 500 for printing on a media web according to another example. Particularly, the method 500 may determine a scaling factor to substantially realign the gapless frames illustrated above in FIG. 4. The processing unit 216 of the print engine controller 210 may implement the method 500. Alternatively, other types of controllers may implement the method 500. The method 500 includes many of the same operations as those discussed above with respect to the method 300 depicted in FIG. 3. Features of the common operations are not discussed in detail with respect to the method 500.

According to an example, a first frame and a second frame are printed without a gap on the media web 115. For instance, the first frame may include a first alignment mark and the second frame may include a second alignment mark.

At block 510, a first encoder count of the second encoder 145 that identifies the distance between a first alignment mark and an end of frame for the first frame may be determined by the processing unit 216. Block 510 may be similar to block 310 in FIG. 3.

At block 520, a second encoder count of the second encoder 145 that identifies the distance between the first alignment mark for the first frame and the second alignment mark for the second frame of the media web 115 may be determined by the processing unit 216. Block 520 may be similar to block 320 in FIG. 3.

At block 530, a difference value between the first encoder count and the second encoder count may be calculated by the processing unit 216. Block 530 may be similar to block 330 in FIG. 3.

At block 540, a determination may be made as to whether the difference value exceeds a predetermined acceptable threshold. An example of the predetermined acceptable threshold may be a value between about 0.25 mm to 0.5 mm. In general, however, the goal of the predetermined acceptable threshold is to adjust the scaling of the second encoder 145 before drifting becomes noticeable on the media web 115, which may be any circumstance where an error is greater than zero.

In response to the difference value exceeding the predetermined acceptable threshold, a scaling factor of the second encoder 145 may be determined based on the calculated difference value, as indicated at block 550. Block 550 is similar to block 340 in FIG. 3.

In addition, at block 560, the processing unit 216 may output an instruction to the second printer unit 160 to print another gapless frame on the media web 115 based on the determined scaling factor for the second encoder 145. The determined scaling factor, for instance, may cause the another frame to be printed at an adjusted size or ratio, as instructed by an output from the processing unit 216 of the second print engine controller 149. Block 560 is similar to block 350 in FIG. 3.

With reference back to block 540, in the event that the difference value does not exceed the predetermined acceptable threshold, i.e., falls below the predetermined acceptable threshold, the processing unit 216 may output an instruction to the second printer unit 160 to immediately print another frame following printing of the second frame by the second printer unit, as indicated at block 570. Particularly, for instance, the processing unit 216 may initiate printing of the another frame without the application of an adjusted scaling factor. In other words, the processing unit 216 may initiate printing of the another frame according to a normal gapless printing routine.

Thus, according to the method 500, a scaling factor may be determined and used to control or adjust the printing of the back frame such that the back frame is in substantial alignment with the front frame. Moreover, the method 500 may be repeated on a substantially continuous basis to adjust the scaling factor as conditions with respect to either or both of the media web 115 and the encoders 120, 145 change. In many instances, therefore, the determination of the scaling factor disclosed herein may also or alternatively pertain to the adjustment of a previously determined or adjusted scaling factor.

Figure 6:
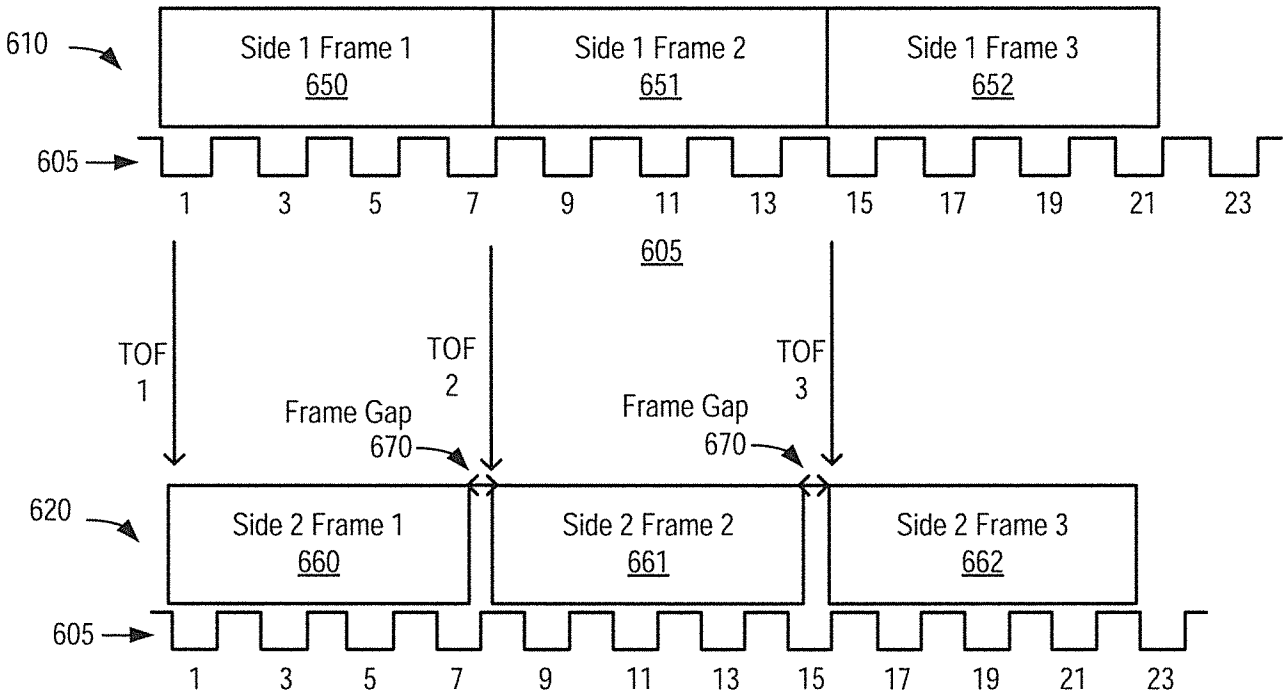
FIG. 6 illustrates an example timing diagram of frame printing triggered by an arrival of an alignment mark in duplex printing systems according to an example of the present disclosure.

FIG. 6 illustrates an example timing diagram of frame printing that is triggered by an arrival alignment mark (e.g., TOF mark) in duplex printing systems according to an example implementation. FIG. 6 is simplified for illustrative purposes. For example, the illustrated encoder counts (i.e., pulses) 605 are simplified to seven counts per frame for explanatory purposes. The examples disclosed herein are not limited to seven counts per frame and may designate any number of counts per frame as appropriate.

In the example of FIG. 6, a second side 620 of the media web 115 may have shrunk, which leads to first side frames 650, 651, 652 on the first side 610 of the media web 115 not matching (i.e., being misaligned with) the second side frames 660, 661, 662 on the second side 620 of the media web 115. Particularly, due to the shrinkage of the media web 115, the end of the first frame of the second side 660 is depicted as being printed short of TOF 2. Additionally, the end of the second frame of the second side 661 is printed short of TOF 3. This, for instance, causes a frame gap 670 between the end of each frame on the second side and the arrival of each subsequent TOF, which triggers the printing of a subsequent frame of the second side 662.

Figure 7:
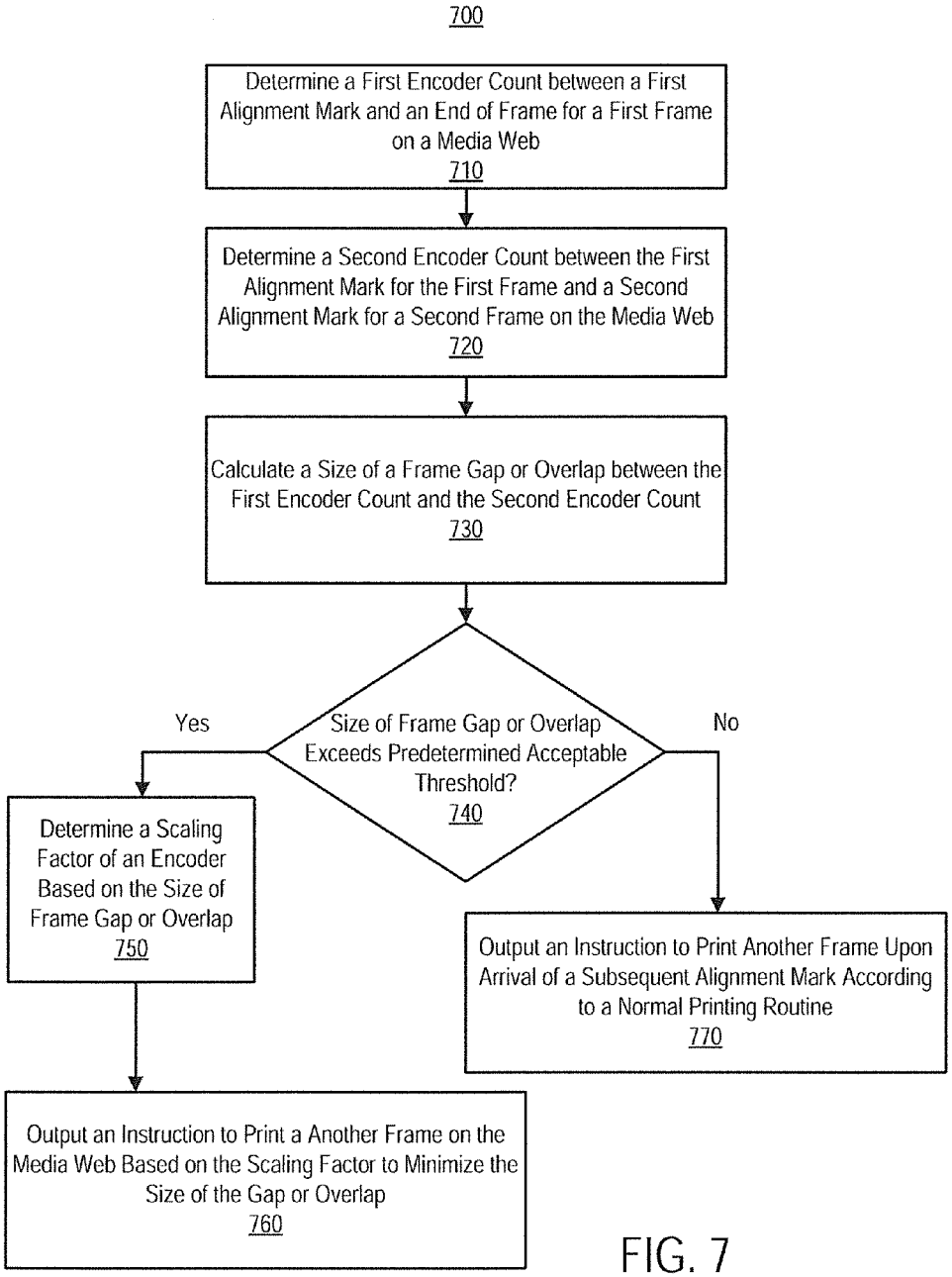
FIG. 7 illustrates a flow diagram of an example method for printing on a media web according to a further example of the present disclosure.

FIG. 7 illustrates a flow diagram of a method 700 for printing on a media web according to another example. The processing unit 216 of the print engine controller 210 may implement the method 700. Alternatively, other types of controllers may implement the method 700. The method 700 includes many of the same operations as those discussed above with respect to the method 500 depicted in FIG. 5. Features of the common operations are not discussed in detail with respect to the method 700. In one implementation, the method 700 may be implemented in conjunction with the method 500. That is, the method 500 may be implemented to determine and apply a scaling factor of the second encoder 145 and the method 700 may be implemented to adjust a scaling factor of the second encoder 145 to adjust the size of the printed frame. By adjusting the size of the printed frame based on the scaling factor, a size of a frame gap may be modified such that the print frame is printed with little or no gap between the print frame and a previously or later printed print frame.

According to an example, a first frame and a second frame are printed upon the arrival of a corresponding alignment mark on the media web 115. For instance, the first frame may include a first alignment mark and the second frame may include a second alignment mark.

At block 710, a first encoder count of the second encoder 145 that is indicative of the distance between a first alignment mark and an end of frame for the first frame may be determined by the processing unit 216. Block 710 may be similar to block 510 in FIG. 5.

At block 720, a second encoder count of the second encoder 145 that is indicative of the distance between the first alignment mark for the first frame and the second alignment mark for the second frame of the media web 115 may be determined by the processing unit 216. Block 720 may be similar to block 520 in FIG. 5.

At block 730, a difference value between the first encoder count and the second encoder count may be calculated by the processing unit 216. This difference value may, for instance, represent a size of a frame gap between the first frame and the second frame. Alternatively, this difference value may represent a size of the frame overlap between the first frame and the second frame. Block 730 is similar to block 530 in FIG. 5.

At block 740, a determination may be made as to whether the size of the frame gap or overlap exceeds a predetermined acceptable threshold.

In response to the size of the gap or overlap exceeding the predetermined acceptable threshold, a scaling factor of the second encoder 145 may be determined based on the calculated size of the frame gap or overlap, as indicated at block 750. Block 750 may be similar to block 550 in FIG. 5.

In addition, at block 760, the processing unit 216 may output an instruction to the second printer unit 160 to print another frame on the media web 115 based on the determined scaling factor for the second encoder 145. The determined scaling factor, for instance, may cause the another frame to be printed at an adjusted size or ratio, as instructed by an output from the processing unit 216 of the second print engine controller 149. Accordingly, the size of the frame gap or overlap may be modified based on the determined scaling factor. Block 760 may be similar to block 560 in FIG. 5.

With reference back to block 740, in response to a determination that the size of the frame gap or overlap does not exceed the predetermined acceptable threshold, i.e., falls below the predetermined acceptable threshold, another frame may be printed upon the arrival of a subsequent alignment mark as instructed by an output from the processing unit 216 of the second print engine controller 149, as indicated at block 770. For instance, the processing unit 216 may initiate printing of the another frame without the application of an adjusted scaling factor. More specifically, the processing unit 216 may initiate printing of the another frame upon the arrival of a subsequent alignment mark according to a normal printing routine.

Thus, according to the method 700, a scaling factor may be determined and used to modify the size of the gaps between back side frames such that the back side frames are in substantial alignment with the front side frames. Moreover, the method 700 may be repeated on a substantially continuous basis to adjust the scaling factor as conditions with respect to either or both of the media web 115 and the encoders 120, 145 change. In many instances, therefore, the determination of the scaling factor disclosed herein may also or alternatively pertain to the adjustment of a previously determined or adjusted scaling factor.

According to an example, adjusting the scaling factor of the second encoder 145 to adjust the size of a frame may be optional depending upon the color of the background of the second frame. For instance, the scaling factor may be adjusted in instances in which the background of the second frame is noticeable with respect to the background of another frame. That is, if the backgrounds of the second frame and the another frame match the color of the media web 115, a gap between the frames may not be noticeable and thus, the scaling factor may not need to be adjusted. However, if the second frame contains a background, at least near an edge of the second frame, that differs in color from the media web 115, the size of the frame gap between the second frame and the another frame may be noticeable. In this instance, the scaling factor may be adjusted and applied.

According to the disclosed examples, method 500 may be implemented to print every frame on the second side with a fixed gap size of size=0. As soon as printing has completed on a first frame, the printing of a second frame may be initiated. In other words, for instance, method 500 may implemented as fixed gap printing on the second side of the media web 115. The gap or overlap may be chosen to be any value. The front to back alignment may then be controlled by adjusting the frame size on the second side, and the frame size may be adjusted by scaling the encoder as discussed herein. For method 700, the gap may be uncontrolled, however, the front to back alignment of the frames may be maintained.

Combining methods 500 and 700 may allow the gap or overlap to be held within a fixed range, and within this range the TOF signal may be used to initiate the printing on the second side to maintain the front to back alignment of the printed frames. Thus, the scaling factor may be adjusted such that on average, the TOF signal arrives in the middle of a predetermined acceptable threshold range (e.g., gap range). In addition, the scaling of the second encoder 145 may be employed such that there was not a noticeable gap, nor a noticeable frame overlap (i.e. the scaling adjustment may be applied before either the gap or the alignment is objectionable).

Some or all of the operations set forth in the methods 300, 500, and 700 may be contained as utilities, programs, or subprograms, in any desired computer accessible medium. In addition, the methods 300, 500, and 700 may be embodied by computer programs, which may exist in a variety of forms both active and inactive. For example, they may exist as machine readable instructions, including source code, object code, executable code or other formats. Any of the above may be embodied on a non-transitory computer readable storage medium.

Examples of non-transitory computer readable storage media include conventional computer system RAM, ROM, EPROM, EEPROM, and magnetic or optical disks or tapes. It is therefore to be understood that any electronic device capable of executing the above-described functions may perform those functions enumerated above.

Figure 8:
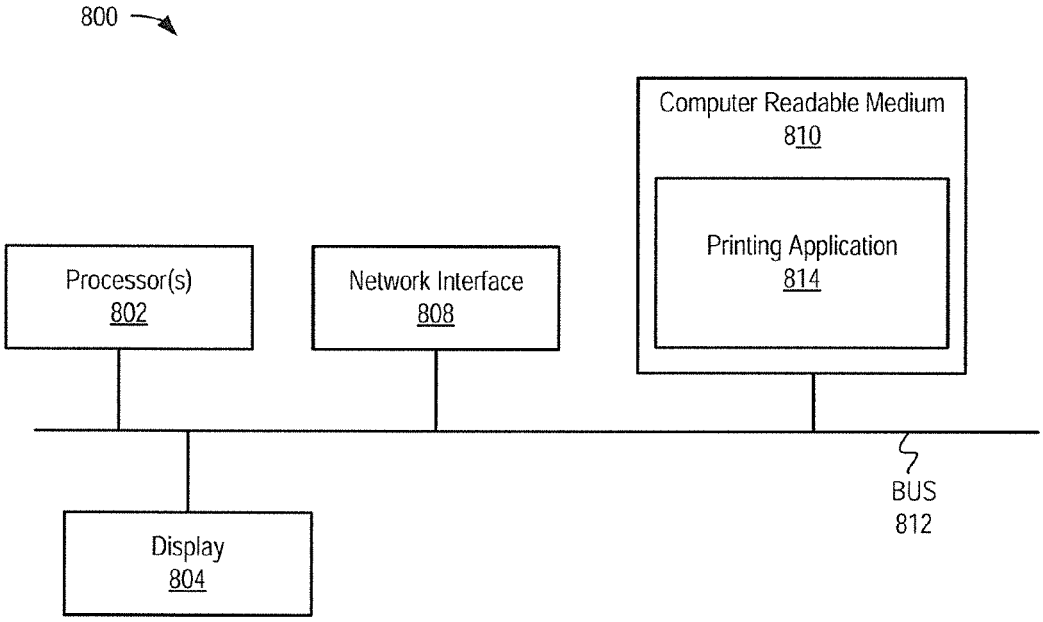
FIG. 8 illustrates a schematic representation of an example computing device, which may be employed to perform various functions of the print engine controller depicted in FIG. 2, according to an example of the present disclosure.

Turning now to FIG. 8, a schematic representation of a computing device 800, which may be employed to perform various functions of the print engine controller 210 depicted in FIG. 2, is shown according to an example implementation. The device 800 may include a processor 802, a display 804, such as a monitor, a network interface 808, such as a Local Area Network LAN, a wireless 802.11x LAN, a 3G mobile WAN or a WiMax WAN, and a computer-readable medium 810. Each of these components may be operatively coupled to a bus 812. For example, the bus 812 may be an EISA, a PCI, a USB, a FireWire, a NuBus, or a PDS.

The computer readable medium 810 may be any suitable medium that participates in providing instructions to the processor 802 for execution. For example, the computer readable medium 810 may be non-volatile media, such as an optical or a magnetic disk; volatile media, such as memory. The computer-readable medium 810 may also store a printing application 814, which may perform the methods 300, 500, and/or 700 of the print engine controller 210 depicted in FIG. 2. In this regard, the printing application 814 may include machine readable instructions or modules that are to perform the operations contained in the methods 300, 500, and/or 700 when executed by the processor 802.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims—and their equivalents—in which all terms are meant in their broadest reasonable sense unless otherwise indicated.

What is claimed is:

1. A method for printing on a media web, comprising:

outputting a first instruction to print a first frame on the media web;

determining, by a processor, a first encoder count of an encoder between a first alignment mark and an end of frame for the first frame;

determining a second encoder count of the encoder between the first alignment mark for the first frame and a second alignment mark for a second frame;

calculating a difference value between the first encoder count and the second encoder count;

determining a scaling factor of the encoder based on the difference value; and outputting another instruction to print another frame on the media web based on the scaling factor.

2. The method of claim 1, wherein determining the scaling factor of the encoder further comprises determining the scaling factor of the encoder to be a scaling factor that causes a predetermined distance between an end of frame for the another frame and a subsequent alignment mark for a subsequent frame to be created.

3. The method of claim 2, further comprising:

determining whether the difference value exceeds a predetermined acceptable threshold, and wherein determining the scaling factor of the encoder further comprises determining the scaling factor of the encoder in response to the difference value exceeding the predetermined acceptable threshold.

4. The method of claim 1, wherein outputting the another instruction further comprises outputting the another instruction to print the another frame at an adjusted size that is based on the scaling factor.

5. The method of claim 1, wherein outputting the another instruction further comprises outputting the another instruction to print the another frame to have an end of frame that occurs substantially at an alignment mark of a subsequent frame.

6. The method of claim 1, wherein outputting the first instruction and the another instruction further comprises outputting the first instruction upon receipt of a signal from a sensor that the first alignment mark has been detected and outputting the another instruction upon receipt of a signal from the sensor that an alignment mark of the another frame has been detected.

7. The method of claim 6, wherein the difference value between the first encoder count and the second encoder count represents a gap or overlap between the end of frame for the first frame and a start of the second frame, and wherein determining the scaling factor of the encoder further comprises determining the scaling factor of the encoder to be a scaling factor that compensates for the difference value to minimize a gap or overlap between an end of frame for the another frame and a start of a subsequent frame.

8. An apparatus for managing printing on a media web, comprising:

a processor;

a memory storing machine readable instructions that are to cause the processor to:

output a first instruction to a printer unit to print a first frame on the media web in response to receipt of a first signal from a sensor that a first alignment mark is detected;

determine a first encoder count of an encoder between the first alignment mark and an end of frame for the first frame;

determine a second encoder count between the first alignment mark for the first frame and the second alignment mark for the second frame in response to receipt of a second signal that a second alignment mark for a second frame is detected;

calculate a difference value between the first encoder count and the second encoder count;

determine a scaling factor of the encoder based on the difference value.

9. The apparatus of claim 8, wherein the machine readable instructions are further to cause the processor to determine the scaling factor of the encoder to be a scaling factor that causes a predetermined distance between an end of frame for the another frame and a subsequent alignment mark for a subsequent frame to be created.

10. The apparatus of claim 9, wherein the machine readable instructions are further to cause the processor to determine whether the difference value exceeds a predetermined acceptable threshold and to determine the scaling factor of the encoder in response to the difference value exceeding the predetermined acceptable threshold.

11. The apparatus of claim 8, wherein the machine readable instructions are further to cause the processor to output another instruction to the printer unit to print the another frame at an adjusted size that is based on the scaling factor.

12. The apparatus of claim 8, wherein the machine readable instructions are further to cause the processor to output the another instruction to the printer unit to print the another frame to have an end of frame that occurs at an alignment mark of a subsequent frame thereby preventing a gap from being created between the end of frame for the another frame and the subsequent frame.

13. A non-transitory computer readable storage medium storing machine-readable instructions that when executed by a processor, cause the processor to:

receive a signal from a sensor that a first alignment mark is detected;

output a first instruction to a printer unit to print a first frame on the media web in response to receipt of the first alignment mark detected signal;

determine a first encoder count of an encoder between the first alignment mark and an end of frame for the first frame;

receive a signal from the sensor that a second alignment mark for a second frame is detected;

determine a second encoder count between the first alignment mark for the first frame and the second alignment mark for the second frame;

calculate a difference value between the first encoder count and the second encoder count;

determine a scaling factor of the encoder based on the difference value, wherein the scaling factor of the encoder is a scaling factor that, when applied to a frame printing operation, causes a predetermined distance between an end of frame for another and a subsequent alignment mark for a subsequent frame to be created; and output another instruction to the printer unit to print the another frame on the media web through application of the scaling factor.

14. The non-transitory computer readable storage medium of claim 13, wherein the machine readable instructions are further to cause the processor to output the first instruction to the printer unit upon receipt of the first alignment mark detected signal and to output the another instruction to the printer unit in response to receipt of an another alignment mark detected signal.

15. The non-transitory computer readable storage medium of claim 14, wherein the difference value between the first encoder count and the second encoder count represents a gap or overlap between the end of frame for the first frame and a start of the second frame and wherein the machine readable instructions are further to cause the processor to determine the scaling factor of the encoder to be a scaling factor that compensates for the difference value to minimize a gap or overlap between an end of frame for the another frame and a start of a subsequent frame.

* * * * *